US005947181A

United States Patent [19]

Davis

[11] Patent Number: 5,947,181

[45] **Date of Patent: *Sep. 7, 1999**

[54] COMPOSITE, INTERNAL REINFORCED CERAMIC CORES AND RELATED METHODS

[75] Inventor: Richard Mallory Davis, Scotia, N.Y.

[73] Assignee: General Electric Co., Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/677,997

[22] Filed: Jul. 10, 1996

[51] Int. Cl.[6] ..... B22D 29/00; B22D 23/00

[52] U.S. Cl. ..... 164/132; 164/47; 164/131; 428/34.4

[58] Field of Search ..... 428/34.4; 164/132, 164/398, 399, 131, 47; 29/889.721

[56] References Cited

U.S. PATENT DOCUMENTS 3,160,931 12/1964 Leach .
4,905,750 3/1990 Wolf .

FOREIGN PATENT DOCUMENTS 0 105 602 4/1984 European Pat. Off. .
1 549 819 8/1979 United Kingdom .
2 102 317 2/1983 United Kingdom .
2 281 238 3/1995 United Kingdom .

*Primary Examiner*—Ponnathapura Achutamurthy
*Assistant Examiner*—P. Ponnaluri
*Attorney, Agent, or Firm*—Nixon & Vanderhye

[57] ABSTRACT

A method of improving structural stability of a ceramic core used in the casting of turbine components includes the steps of a) providing a die having a predetermined geometry which gives the ceramic core a shape corresponding to interior spaces in the turbine component; b) inserting elongated strengthening members into interior or more areas of the die corresponding to one or more of the interior spaces; c) injecting a ceramic slurry into the die so as to substantially enclose the strengthening members; and d) firing the ceramic slurry to form a hardened ceramic core. A ceramic core used in a high temperature gas turbine component casting process includes a ceramic body having a geometry corresponding to internal passages of a gas turbine component; and at least one elongated rod or tube incorporated in the ceramic body, the rod or tube comprised of a material which retains structural stability at temperatures in excess of about 2600° F. In a method of casting a gas turbine component having interior passages, and including inserting a ceramic core in a casting die wherein the ceramic core is shaped to correspond to the interior passages, pouring molten metal into the die, and solidifying the molten metal and extracting the ceramic core, an improvement is disclosed which includes incorporating at least one strengthening member in the ceramic core to improve structural stability of the core during pouring and solidifying the molten metal.

19 Claims, 3 Drawing Sheets

COMPOSITE, INTERNAL REINFORCED CERAMIC CORES AND RELATED METHODS

TECHNICAL FIELD

This invention relates generally to the construction of ceramic cores used in casting processes and specifically, to ceramic cores used in the casting of gas turbine blades and nozzles which have internal cooling passages.

BACKGROUND

Ceramic cores are used to form cooling cavities and passages within airfoil portions of buckets and nozzles used in the hot section of a gas turbine. Typically, the cooling passages in, for example, a turbine stage one, and sometimes stage two, bucket form a serpentine shape. This serpentine geometry usually includes 180° turns at both the root and the tip of the airfoil. The turns at the tip end of the airfoil are generally well supported outside of the airfoil. The turns at the root, on the other hand, are generally supported by cross-ties of small conical (or similar) geometry, which attach at one end to the root turns and at the opposite end to the coolant supply and/or exit passages in the turbine bucket shank. Thus, the ceramic core is essentially a solid body which is shaped to conform to the complex interior coolant passages of the bucket. The core is placed within a casting mold prior to pouring of molten metal into the mold to form the bucket. A casting mold which holds the core consists of a ceramic shell which contains the molten metal, forms the exterior shape of the component, and fixes the ceramic core within the part being cast.

Ceramic cores are formed by creating a die of the cooling circuit geometry into which a slurry of the desired composition is injected. The "green" material is then fired to cure the ceramic, making the core stable and rigid. Of course, the geometry and conditions to which the ceramic core are exposed in the casting mold are important considerations in maintaining the structural stability of the core. For example, airfoil lengths for certain gas turbine nozzles and buckets for which the cooling geometry require core stability, range from approximately six inches to twelve inches and longer. Typically, ceramic core compositions have been formulated to achieve structural integrity under moderately high temperatures for extended lengths of time. During casting, however, the ceramic core is exposed to molten metal which can be as hot as 2700° F. Directional solidification of the metal, for example, producing either columnar or single crystal grain structures, requires very slow withdrawal rate from the furnace. This slow rate exposes the ceramic core to very high temperatures for extended periods of time. The ceramic core tends to lose its structural stability under these conditions, and deforms due to its own weight. This phenomenon, known as "slumping", causes undesirable variations in the final product's wall thickness between the mold and the core. The problem has been linked to the use of more advanced nickel-base superalloys with hotter pouring temperatures and longer withdrawal times.

There are certain ceramic compositions, however, which, upon a non-reversible phase change, produce extremely hard and stable structures with minimal slumping during casting. The difficulty with these compositions, however, is that the normal core removal process (high temperature leaching baths) does not work well. Since leaching represents the only non-destructive core removal technique available, there is no viable process to remove the hard stable cores from the casting.

DISCLOSURE OF THE INVENTION

The object of this invention is to achieve effective strengthening of the ceramic core in an airfoil (specifically, but not necessarily limited to turbine buckets and nozzles), while providing cost effective core removal. Generally, in accordance with this invention, a strengthening member (or members) is provided inside the ceramic core, made of a material (or materials) which has structural stability at the high temperatures (greater than 2600° F.) of molten alloys used for gas turbine hot section components and the long times necessary to achieve the desired crystalline structure of the metal. The geometry of the strengthening member or members should be small enough to permit removal, via available openings in the component, once the casting process is complete.

The strengthening rod may be of any appropriate cross-sectional shape and may also be provided with external ridges (similar to "re-bar" used to reinforce concrete) to provide additional adherence to the ceramic, and also for additional support of the strengthening member itself. The rod may be placed into the core die prior to injection of the ceramic slurry, similar to the way in which a core is placed in a wax injection die to create a wax replica of the component in an investment casting process.

The strengthening member or rod is smaller in cross-section than the desired passage geometry, and smaller than the opening at the top of the bucket. This is done to inject the normal ceramic compound about the member and to facilitate removal of the member after the core removal process is completed, using current conventional removal techniques, including physical removal through openings or chemical leaching processes.

As already mentioned, the strengthening member should be made of material which maintains structural rigidity at high molten metal pouring temperatures. Suitable materials include alumina, quartz, molybdenum, tungsten, or tungsten carbide.

Accordingly, in one aspect, the invention provides a method of improving structural stability of a ceramic core used in the casting of turbine components comprising the steps of:

a) providing a die having a predetermined geometry which gives the ceramic core a shape corresponding to interior spaces in the turbine component;

b) inserting elongated strengthening members into one or more interior areas of the die corresponding to the interior spaces;

c) injecting a ceramic slurry into the die so as to substantially enclose the strengthening members; and d) firing the ceramic slurry to form a hardened ceramic core.

In another aspect, the invention provides a ceramic core used in a high temperature gas turbine component casting process, comprising a ceramic body having a geometry corresponding to internal passages of a gas turbine component; and at least one elongated rod or tube incorporated in the ceramic body, the rod or tube comprised of a material which retains structural stability at temperatures in excess of about 2600° F.

In still another aspect, the invention provides a method of casting a gas turbine component having interior passages, and including inserting a ceramic core into a casting die wherein the ceramic core is shaped to correspond to the interior passages, pouring molten metal into the die, solidifying the molten metal and extracting the ceramic core, an improvement comprising incorporating at least one strengthening member in the ceramic core to improve structural stability of the core during pouring and solidifying the molten metal.

Other objects and advantages of the subject invention will become apparent from the detailed description which follows.

BEST MODE FOR CARRYING OUT THE INVENTION

Figure 1:
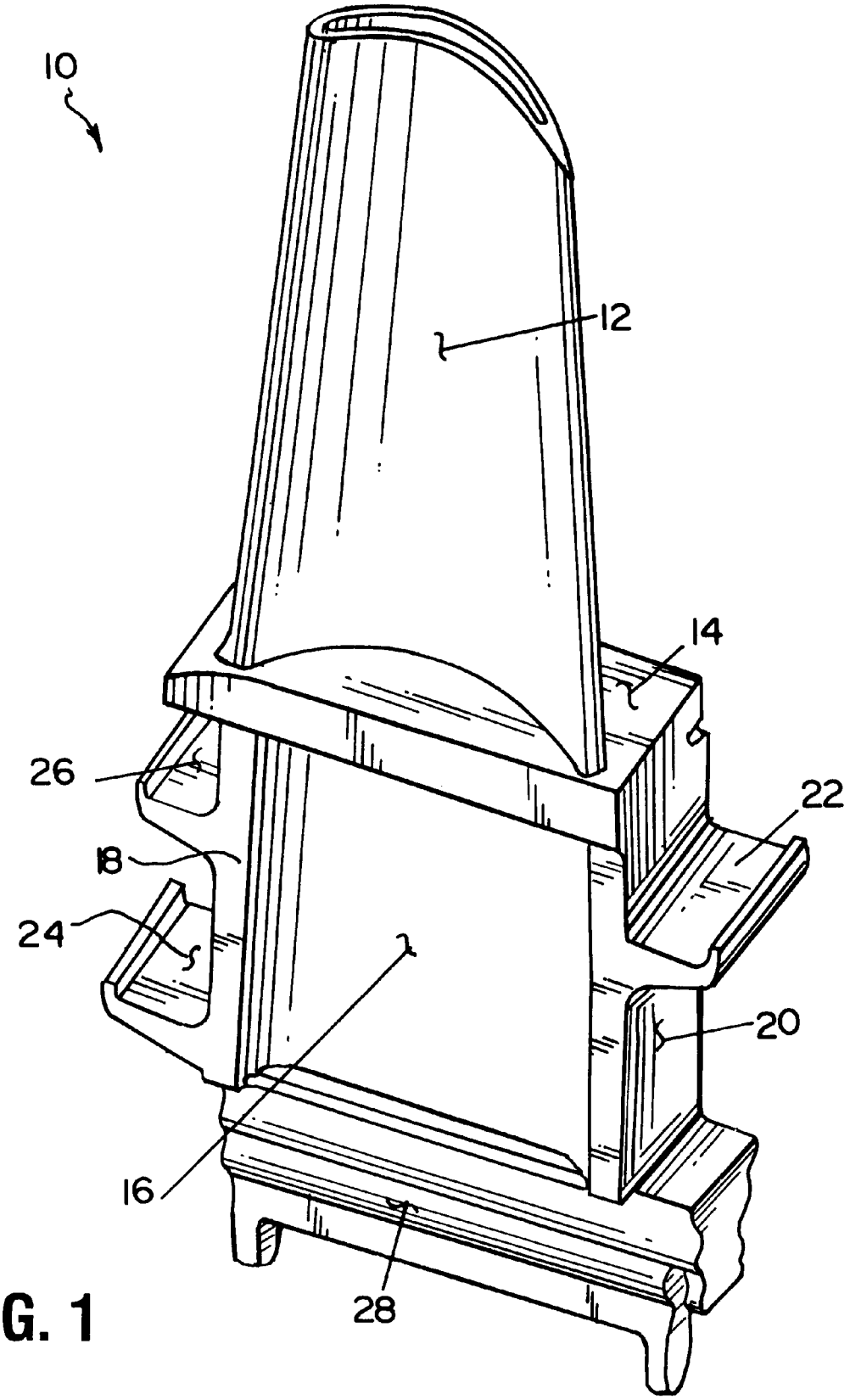
FIG. 1 illustrates a turbine bucket of the type used in the gas turbine in accordance with this invention.

With reference now to FIG. 1, a known turbine bucket construction 10 includes an airfoil 12 attached to a platform portion 14 which seals the shank 16 from the hot gases of the turbine flow path. The shank 16 is covered by forward and aft integral cover plates 18, 20, respectively. So-called angel wings 22, 24 and 26 provide sealing of the wheel space cavities. The bucket is attached to the turbine rotor disk (not shown) by a conventional dovetail 28. In some bucket applications, an appurtenance under the bottom tang of the dovetail is used for admitting and exiting a coolant fluid such as air or steam. The above described bucket is typical of a stage one gas turbine bucket, but it will be appreciated that other components, including the stage one nozzle, the stage two nozzle, the stage two bucket, etc. can utilize the strengthened ceramic core in accordance with this invention.

Figure 2:
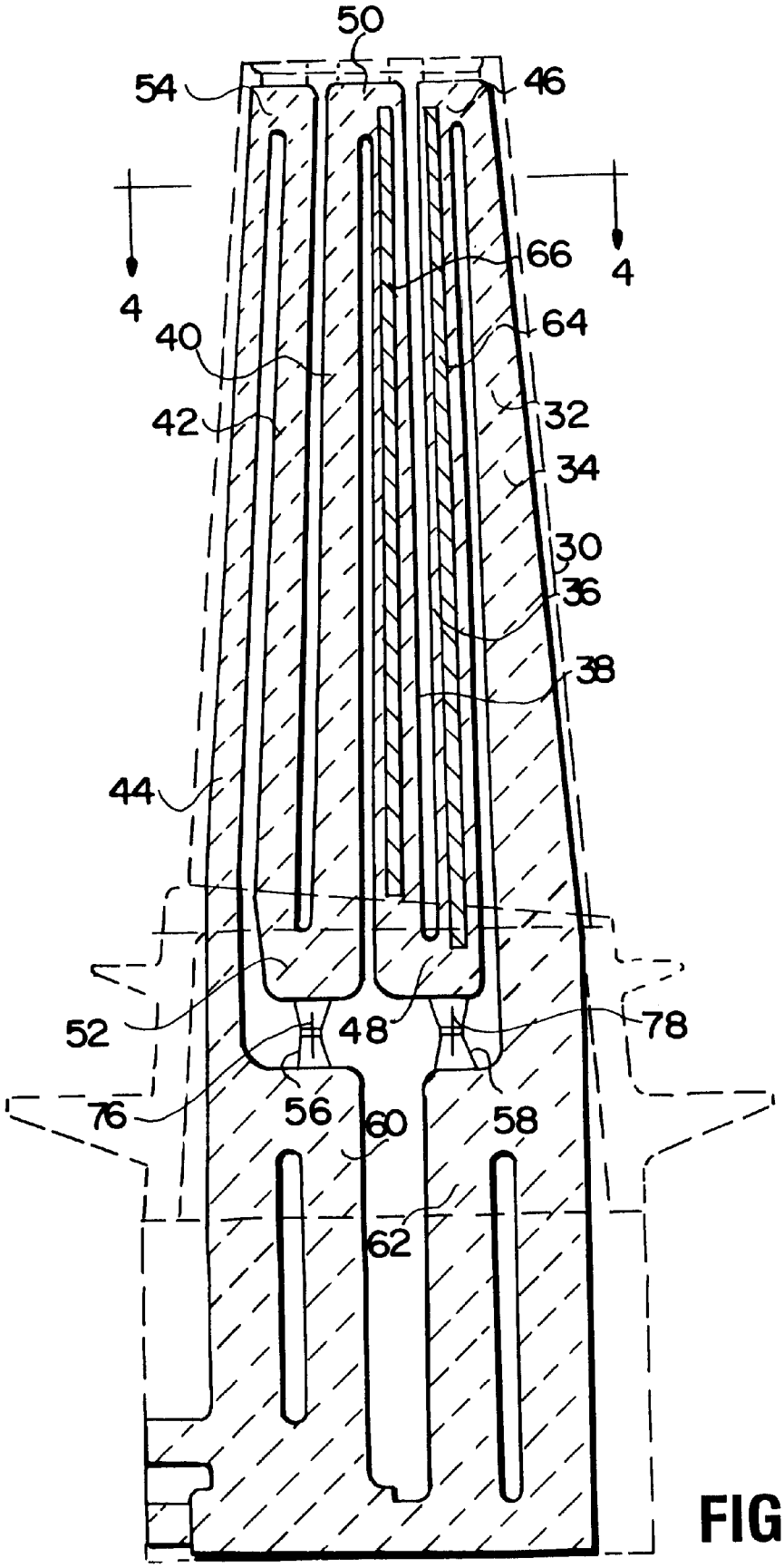
FIG. 2 is a side elevation of a turbine bucket after casting, but still containing a ceramic core with strengthening members in place in accordance with this invention.

Turning now to FIG. 2, a simplified representation of the bucket in its manufacturing stage is illustrated. The outer dotted lines 30 represent the internal surfaces of a casting mold, and the ceramic core is indicated by reference numeral 32. It will be understood that the ceramic core defines the coolant passages in the finally formed bucket and that the remaining spaces between various portions of the ceramic core and the casting mold 30 will be filled with molten metal during casting of the bucket. The internal coolant passage, as defined by the ceramic core, has a generally serpentine configuration with individual radial inflow and outflow passage sections 34, 36, 38, 40, 42 and 44. Passages 34 and 36 are connected by a U-bend at 46 located at the tip of the airfoil section. Similar U-bends are formed at inner and outer portions of the airfoil and are designated by reference numerals 48, 50, 52 and 54. The so-called root turns 48 and 52 of the ceramic core are supported by cross ties 56 and 58 which extend to (and thus connect to) portions 60 and 62 of the core which will ultimately form entry or exit passages for the coolant into the airfoil. The cross ties 56, 58, are shown to have a generally hourglass configuration but other cross-sectional shapes may be employed as well.

Figure 3:
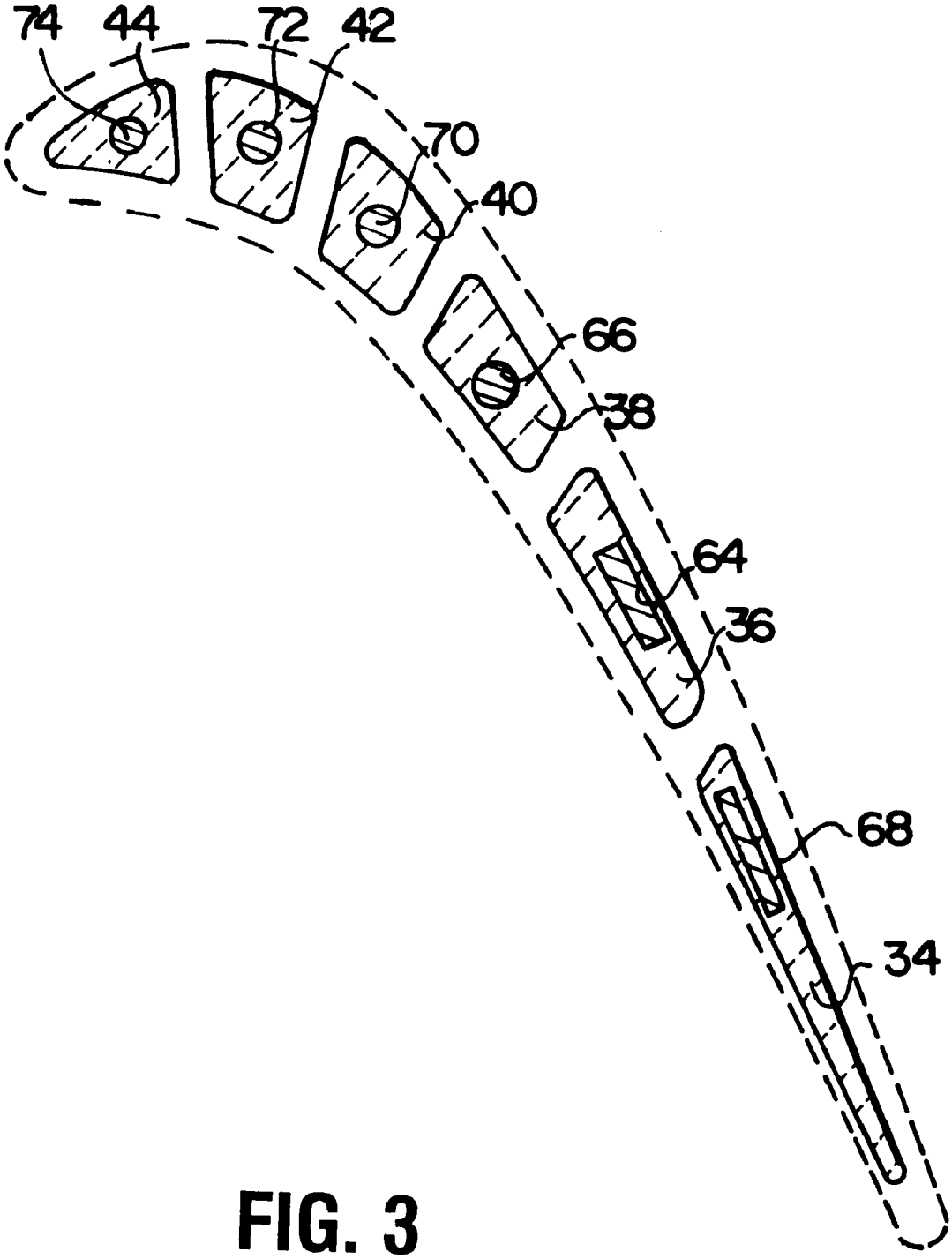
FIG. 3 is a section taken along the line 4—4 of FIG. 2.

FIG. 2 also illustrates a pair of strengthening members or solid rods 64, 66 which extend substantially the entire length of the ceramic core sections 36, 38. One of these, as shown in FIG. 3, has a rectangular cross-sectional shape but other shapes can be utilized. It is also noted that FIG. 2 shows only two strengthening members simply for ease of understanding, while FIG. 3 illustrates not only the strengthening members 64 and 66, but additional strengthening members 68, 70, 72 and 74 can be used, for example, one in each of the ceramic core sections 34, 36, 38, 40, 42 and 44. The cross-sectional shapes of the strengthening members can vary as between adjacent passages as shown in FIG. 3, where some of the strengthening members are rectangular and others are circular in cross-section.

Returning now to FIG. 2, additional core strengthening members 76 and 78 are shown extending through the cross-ties 56 and 58, respectively. Thus, depending on the particular bucket and/or nozzle application, strengthening members as described hereinabove can be employed in any or all of the serpentine cooling sections of the ceramic core, and/or in the cross-ties 56 and 58 of the core.

As indicated earlier, the strengthening members should be made of a material which maintains structural rigidity at high molten metal pouring temperatures and, as noted above, materials such as alumina, quartz, molybdenum, tungsten and tungsten carbide are suitable, with alumina the presently preferred material.

The strengthening members as described herein may also take the form of hollow tubes, and additional strength can be gained by filling the interior of the tubes with molybdenum or tungsten carbide or some other ceramic composition which would undergo a phase change during the casting process and become hard. Of course, in the event hollow strengthening members are utilized, the ends of the members would be sealed prior to injection of the ceramic material into the core die.

The manner in which the above described strengthening members are placed and held within the ceramic core-forming die during the forming of the ceramic core, is well within the skill of the art and need not be described in any detail here. After the pouring of the ceramic slurry into the core-forming die, the material is fired to cure the ceramic, thereby making the core stable and rigid. The ceramic core is then placed in the casting mold and made ready for pouring of the molten metal material to form the bucket.

With certain materials utilized as the strengthening members, including alumina, there may be a problem of thermal expansion of the strengthening members to the extent of forming cracks in the ceramic core. To alleviate this problem, wax extensions can be added to one or both ends of the strengthening members so as to allow the strengthening members to expand axially under the high molten metal pouring temperatures. In other words, under high heat, the wax ends will melt and provide space for axial expansion of the tubes. As also indicated earlier, the ceramic cores are normally removed by conventional leaching processes. When strengthening rods or tubes are employed, the chemical leach bath can be modified to remove the rods as well. Alternatively, and depending on the size and location of the strengthening members, they can be physically removed through openings in the bucket.

While the invention has been described in terms of application to gas turbine bucket and nozzle manufacturing, the invention may well have applicability to forming other components where ceramic core strengthening is desirable. Accordingly, while the invention has been described in connection with what is presently considered to be the most practical and preferred embodiment (gas turbine buckets and nozzles), it is to be understood that the invention is not to be limited to the disclosed embodiment, but on the contrary, is intended to cover various modifications and equivalent arrangements included within the spirit and scope of the appended claims.

What is claimed is:

1. A method of improving structural stability of a ceramic core used in the casting of hollow components comprising the steps of:

a) providing a die having a geometry which gives the ceramic core a shape corresponding to interior spaces in the component;

b) inserting elongated strengthening members into one or more interior areas of said die corresponding to said interior spaces, said strengthening members having a length substantially equal to a corresponding length of said interior passages and said strengthening members being made of a material selected from the group consisting of alumina, quartz, molybdenum, tungsten and tungsten carbide;

c) injecting a ceramic slurry into said die so as to completely enclose said strengthening members; and d) firing the ceramic slurry to form a hardened ceramic core.

2. The method of claim 1 wherein said strengthening members are made of alumina.

3. The method of claim 1 wherein said strengthening members are solid alumina rods.

4. The method of claim 1 wherein said strengthening members are hollow alumina tubes.

5. The method of claim 4 wherein said hollow alumina tubes are filled with another ceramic material of different composition.

6. The method of claim 1 wherein said die is configured to give the ceramic core a shape corresponding to internal coolant passages in a gas turbine bucket or nozzle.

7. The method of claim 1 wherein said strengthening members are made of material having structural stability at temperatures in excess of 2600° F.

8. The method of claim 1 wherein said strengthening members have a round cross-section.

9. The method of claim 1 wherein said strengthening members have a rectangular cross-section.

10. A ceramic core used in a high temperature hollow component casting process, comprising:

a ceramic body having a geometry corresponding to internal passages of a hollow component; and a strengthening member comprising at least one elongated rod or tube completely enclosed within said ceramic body, said rod or tube made of a material which retains structural stability at temperatures in excess of about 2600° F.

11. The ceramic core of claim 10 wherein said ceramic body has a geometry corresponding to internal coolant passages in a turbine bucket or nozzle.

12. The ceramic core of claim 11 wherein a pair of elongated rods are located in each of said internal coolant passages.

13. The ceramic core of claim 10 wherein said at least one rod or tube is composed of alumina.

14. The ceramic core of claim 10 including a plurality of elongated rods or tubes.

15. In a method of casting a gas turbine component having interior passages, and including inserting a ceramic core into a casting die wherein the ceramic core is shaped to correspond to said interior passages, pouring molten metal into said die, solidifying said molten metal and extracting said ceramic core, an improvement comprising incorporating at least one strengthening member in said ceramic core to improve structural stability of said core during pouring and solidifying said molten metal, said strengthening member consisting of a solid rod completely enclosed within said core and having a length substantially equal to a corresponding length of said interior passages, and wherein said strengthening member is made of a material selected from the group consisting of alumina, quartz, molybdenum, tungsten and tungsten carbide.

16. The method of claim 15, and further including the step of removing said ceramic core and then extracting said at least one strengthening member through openings in the gas turbine component.

17. The method of claim 15 and further including the step of removing said ceramic core and said strengthening member by leaching.

18. The method of claim 16 wherein the ceramic core is removed by leaching.

19. The ceramic core of claim 10 including one or more wax extensions on one or both ends of said elongated rod or tube to permit said rod or tube to axially expand under molten metal pouring temperatures.

* * * * *